US011130067B2

(12) United States Patent
Groels

(10) Patent No.: US 11,130,067 B2
(45) Date of Patent: Sep. 28, 2021

(54) SWING RIDE ATTRACTION WITH CONTROL MEANS FOR CONTROLLING THE SWING

(71) Applicant: K.I.G. HEERENVEEN B.V., Terband-Heerenveen (NL)

(72) Inventor: Hendrikus Maria Petro Johannes Helena Groels, Valkenswaard (NL)

(73) Assignee: K.I.G. Heerenveen B.V., Terband-Heerenveen (NL)

( * ) Notice: Subject to any disclaimer, the term of this patent is extended or adjusted under 35 U.S.C. 154(b) by 0 days.

(21) Appl. No.: 15/929,258

(22) Filed: Apr. 15, 2020

(65) Prior Publication Data

US 2020/0330884 A1 Oct. 22, 2020

(30) Foreign Application Priority Data

Apr. 18, 2019 (NL) ..... 2022973

(51) Int. Cl.
*A63G 1/28* (2006.01)
*A63G 1/08* (2006.01)

(52) U.S. Cl.
CPC *A63G 1/28* (2013.01); *A63G 1/08* (2013.01)

(58) Field of Classification Search
CPC . A63G 1/00; A63G 1/28; A63G 31/00; A63G 31/02
USPC ..... 472/29, 33, 46
See application file for complete search history.

(56) References Cited

U.S. PATENT DOCUMENTS 1,877,656 A 9/1932 Giraud
3,598,403 A 8/1971 Bartlett
6,022,276 A * 2/2000 Knijpstra ..... A63G 1/28 472/33
8,721,463 B2 * 5/2014 Zambelli ..... A63G 1/24 472/31

(Continued)

FOREIGN PATENT DOCUMENTS

DE 3208620 A1 9/1983
EP 1726345 B1 7/2008

(Continued)

OTHER PUBLICATIONS

European Search Report in application No. EP20169612, dated Aug. 31, 2020.

*Primary Examiner* — Kien T Nguyen
(74) *Attorney, Agent, or Firm* — Oppedahl Patent Law Firm LLC

(57) ABSTRACT

The invention relates to an attraction (1) for amusement rides, such as a fairground attraction or an amusement park attraction, comprising a mast (10), a base frame (13), which is rotatably attached to the mast and which extends radially from the mast, means for rotating the base frame, a plurality of subframes (20), each comprising a stiff connecting arm to which a gondola with one or more passenger seats is attached. The subframes (20) are circumferentially distributed, each pivotably suspended by means of the connecting arm on the base frame (13), such that the subframes with gondolas swing upon rotation of the base frame under the influence of the centrifugal force. The attraction is further provided with control means for controlling the swing of the subframes with gondolas relative to the base frame, which control means are arranged to move the center of gravity of the subframe (20) relative to the base frame (13).

9 Claims, 6 Drawing Sheets

(56) References Cited

U.S. PATENT DOCUMENTS

| | | | | |
|---|---|---|---|---|
| 2009/0209357 | A1* | 8/2009 | Crawford | A63G 1/30<br>472/130 |
| 2012/0149479 | A1 | 6/2012 | Nemeth | |

FOREIGN PATENT DOCUMENTS

| | | | |
|---|---|---|---|
| GB | 531981 | A | 1/1941 |
| NL | 2009911 | C2 | 6/2014 |
| NL | 2009911 | C2 | 6/2014 |
| WO | WO2015169336 | A1 | 11/2015 |

* cited by examiner

SWING RIDE ATTRACTION WITH CONTROL MEANS FOR CONTROLLING THE SWING

The present invention relates to an amusement ride attraction, such as a fairground attraction or amusement park attraction, comprising a mast, a base frame rotatably attached to the mast and extending radially from the mast, means for rotating the base frame, a number of subframes, each comprising a stiff connecting arm to which a gondola with one or more passenger seats is attached, wherein the subframes are distributed circumferentially, each pivotably suspended from the base frame by means of the connecting arm, such that the subframes with gondolas swing upon rotation of the base frame under the influence of the centrifugal force, wherein the attraction further comprises control means for controlling the swing of the sub frames with gondolas relative to the base frame.

Such an attraction is known in the art, for example from GB531981 and U.S. Pat. No. 5,820,469.

In the known attractions, the control means are arranged for movement of a vertical surface that catches wind, for example a rudder. The manipulation of such a surface is perceived by the passengers as clumsy.

The object of the invention is to provide an attraction of the above type with alternative control means.

To this end, the attraction according to the invention is characterized in that the control means are arranged to displace the center of gravity of the subframe relative to the base frame. By moving the center of gravity, the path of the subframe around the mast will change under the influence of gravity. The attraction according to the invention does not need wind force or air resistance to function.

The invention provides in a first variant an attraction according to the preamble of claim 1, wherein each gondola is movably attached in the subframe and wherein the control means are arranged for movement of the gondola in the subframe in radial direction with respect to the mast.

In a further elaboration of the first variant, each gondola is rotatably attached to the connecting arm, wherein the center of gravity of the gondola is positioned eccentrically with respect to the connecting arm and wherein the control means are arranged for rotation of the gondola with respect to the connecting arm.

In a second variant, the invention provides an attraction according to the preamble of claim 1, wherein each subframe is provided with an additional mass, which is arranged movably on the subframe, and wherein the control means are arranged for displacing the additional mass in radial direction relative to the mast. In a further elaboration of the second variant, the additional mass is arranged on the gondola. According to a further elaboration, each gondola is fixedly attached in the associated subframe.

Both variants are an elaboration of the same inventive concept, namely that the control means are arranged to move the center of gravity of the subframe relative to the base frame. In other terms, in both variants, a mass is moved in the subframe in a radial direction relative to the mast. This mass is preferably located at the end of the connecting arm and is formed, for example, by either the gondola itself or by an additional mass on the gondola. The mass has no vertical surface, which is arranged to catch wind.

The attraction according to the invention has the advantage that the swinging range can be simply increased by increasing the movable mass. In the prior art, in order to achieve this effect, the vertical surface, such as the rudder, must be enlarged, making its manipulation even more difficult.

In addition, in the attraction according to the invention, the subframe can swing without rotation of the base frame relative to the mast because only gravity is used to initiate a rocking motion.

In a preferred embodiment, the control means comprise passenger control means which are arranged in the gondola and are arranged to be controlled by a passenger in the gondola. The passengers themselves have influence on the sensation they experience during the ride. The passenger control means are preferably actuated, for instance pneumatically, hydraulically or electrically actuated.

In a further preferred embodiment, the control means comprise central control means, which are arranged for central control by an operator outside the attraction.

According to an elegant preferred embodiment, each subframe is pivotably suspended on the base frame about a pivot axis by means of the connecting arm and each subframe is provided with a counterweight, which is fixedly attached to the end of the subframe opposite the gondola above the pivot axis. The counterweight influences the swing and provides an extra sensation during the ride.

In another preferred embodiment, the attraction further comprises a hub movably mounted to the mast in the longitudinal and circumferential direction of the mast and means for moving the hub. In this embodiment the gondolas can be brought to a great height along the mast prior to or simultaneously with the rotation, which gives the passengers a different sensation.

The invention will now be further elucidated with reference to the accompanying figures, in which.

Figure 1:
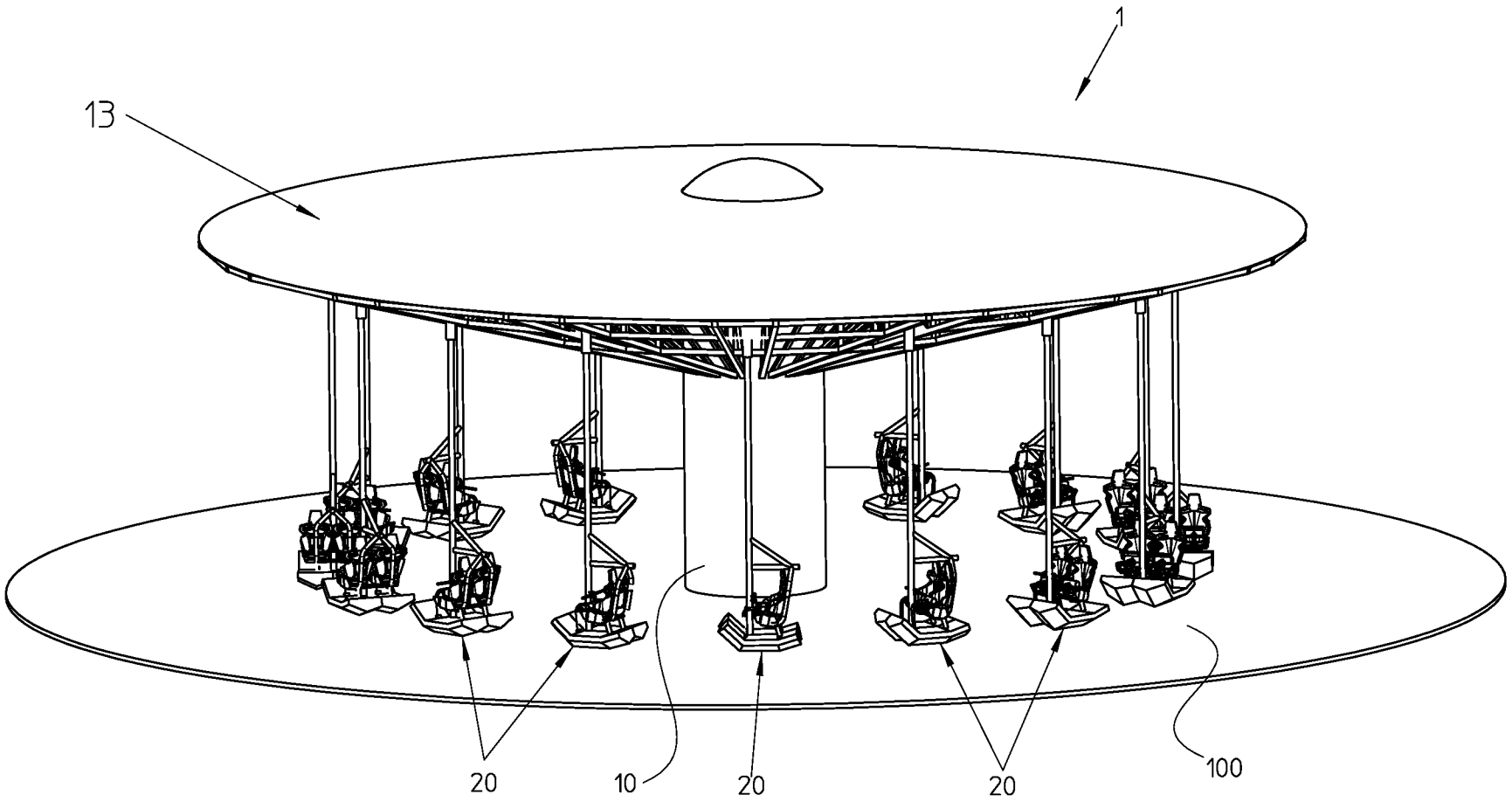
FIG. 1 shows a schematic view of a first preferred embodiment of the swing ride attraction according to the invention in the entry position.
Figure 2:
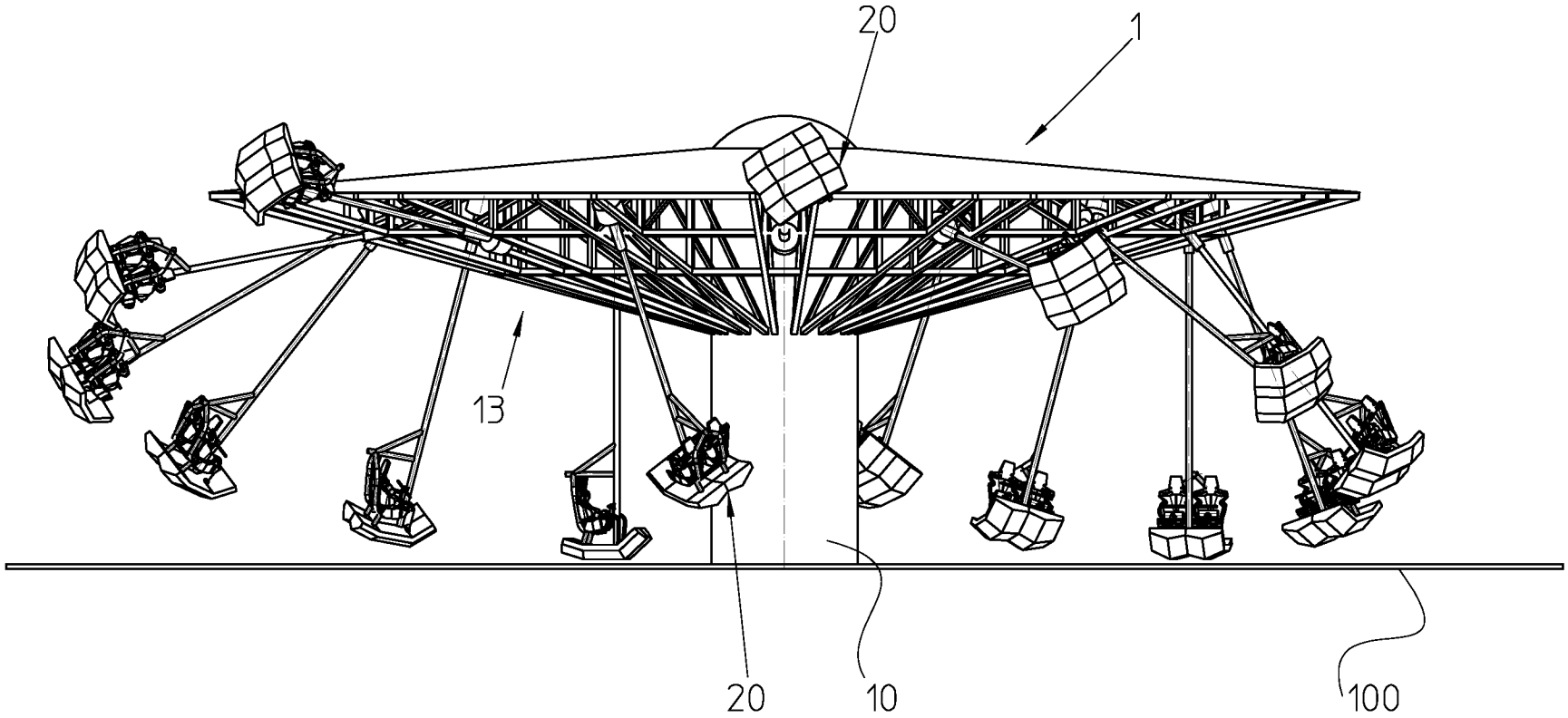
FIG. 2 shows the swing ride attraction of FIG. 1 in the operating position.

FIG. 1 shows an attraction 1 for amusement rides according to the invention in a first preferred embodiment. FIG. 1 shows the attraction 1 in the entry position. FIG. 2 shows the attraction 1 in operation. The attraction 1 is a swing ride attraction which is suitable as a mobile attraction, for example a fairground attraction, and as a fixed attraction, for example an amusement park attraction.

The attraction 1 comprises a substantially vertical mast 10 and a base frame 13 which is attached to the mast 10 and extends radially from the mast 10. The base frame 13 is rotatably mounted around the mast 10. A suitable rotatable attachment such as a hub (not shown) and means for rotating the hub are known in the relevant art.

The attraction 1 further comprises a number of subframes 20, which are freely pivotably suspended from the base frame 13 and distributed in the circumferential direction. Each subframe 20 includes a stiff connecting arm 21 to which a gondola 22 with one or more passenger seats 23 is attached. When the base frame 13 is rotated, the subframes 20 with gondolas 22 swing under the influence of the centrifugal force. The connecting arms 21 preferably have a light construction. This can be achieved by making the connecting arms hollow, for example tubular or beam shaped.

According to the inventive concept, each gondola 22 can follow an individual path while swinging. This is shown in FIG. 2, in which the gondolas take different positions relative to the base frame 13.

Figure 3:
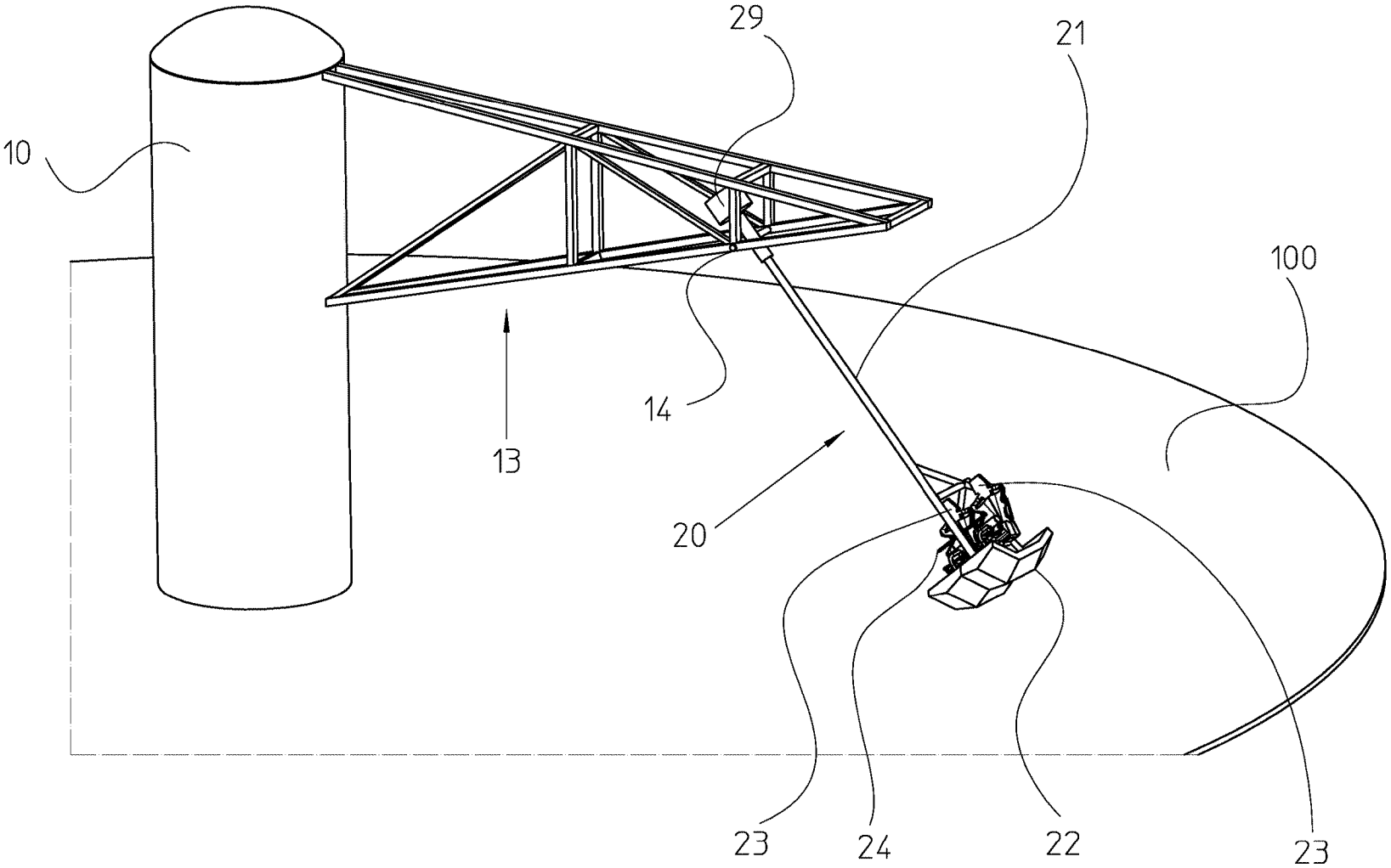
FIG. 3 shows a part of the swing ride attraction of FIG. 2 in more detail.
Figure 4:
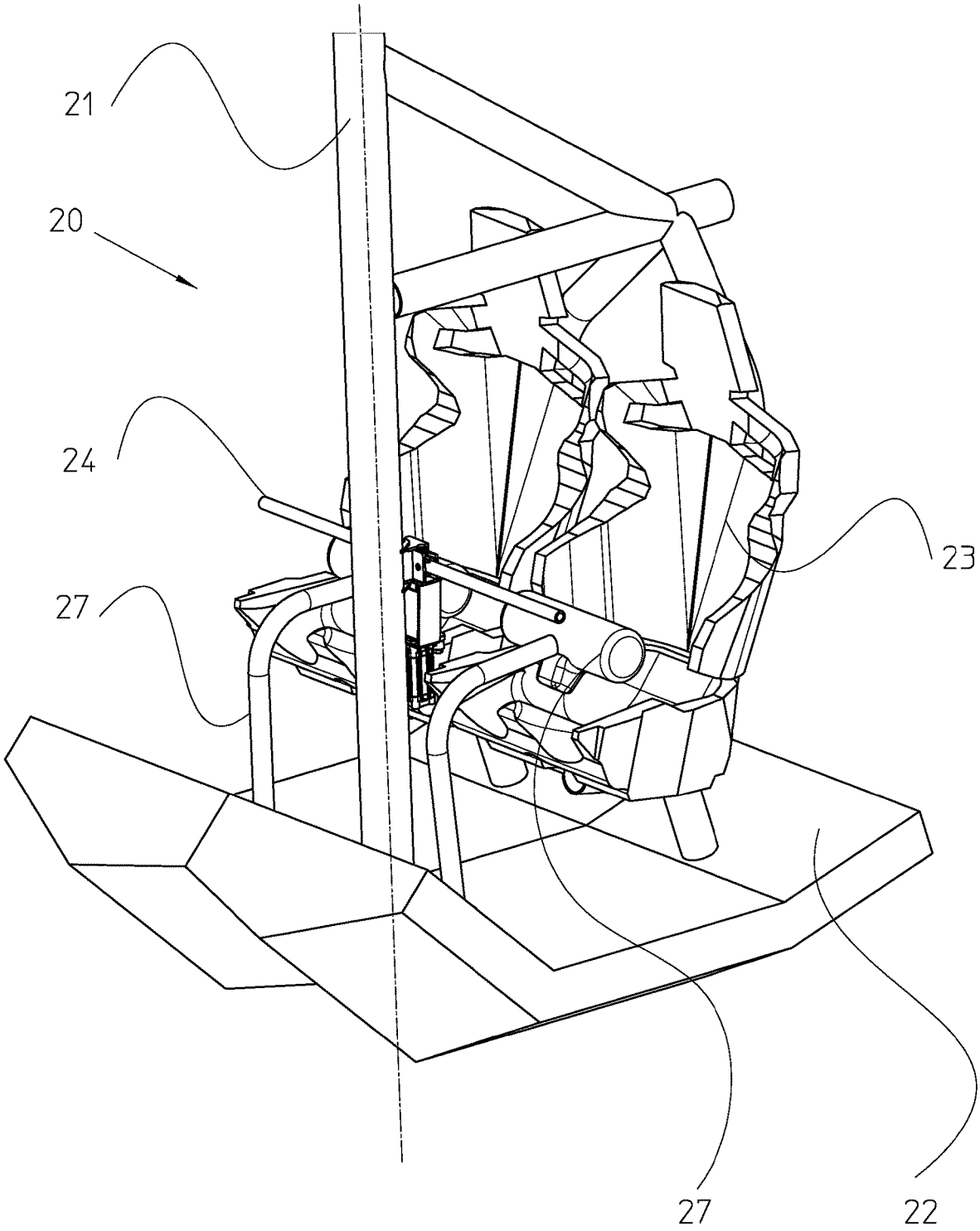
FIG. 4 shows a part of FIG. 3 in more detail.

FIG. 3 shows in more detail a part of the attraction 1 in operation with one subframe 20. FIG. 4 shows one gondola of the attraction 1 at rest.

In the first preferred embodiment, each gondola 22 is rotatably mounted in the associated subframe 20, and each gondola 22 is provided with control means arranged to rotate the gondola relative to the subframe. Preferably, each gondola 22 is rotatably mounted about the connecting arm 21, the center of gravity of the gondola is eccentric with respect to the connecting arm 21 and the control means 24 are arranged to rotate the gondola around the connecting arm 21.

Figure 5:
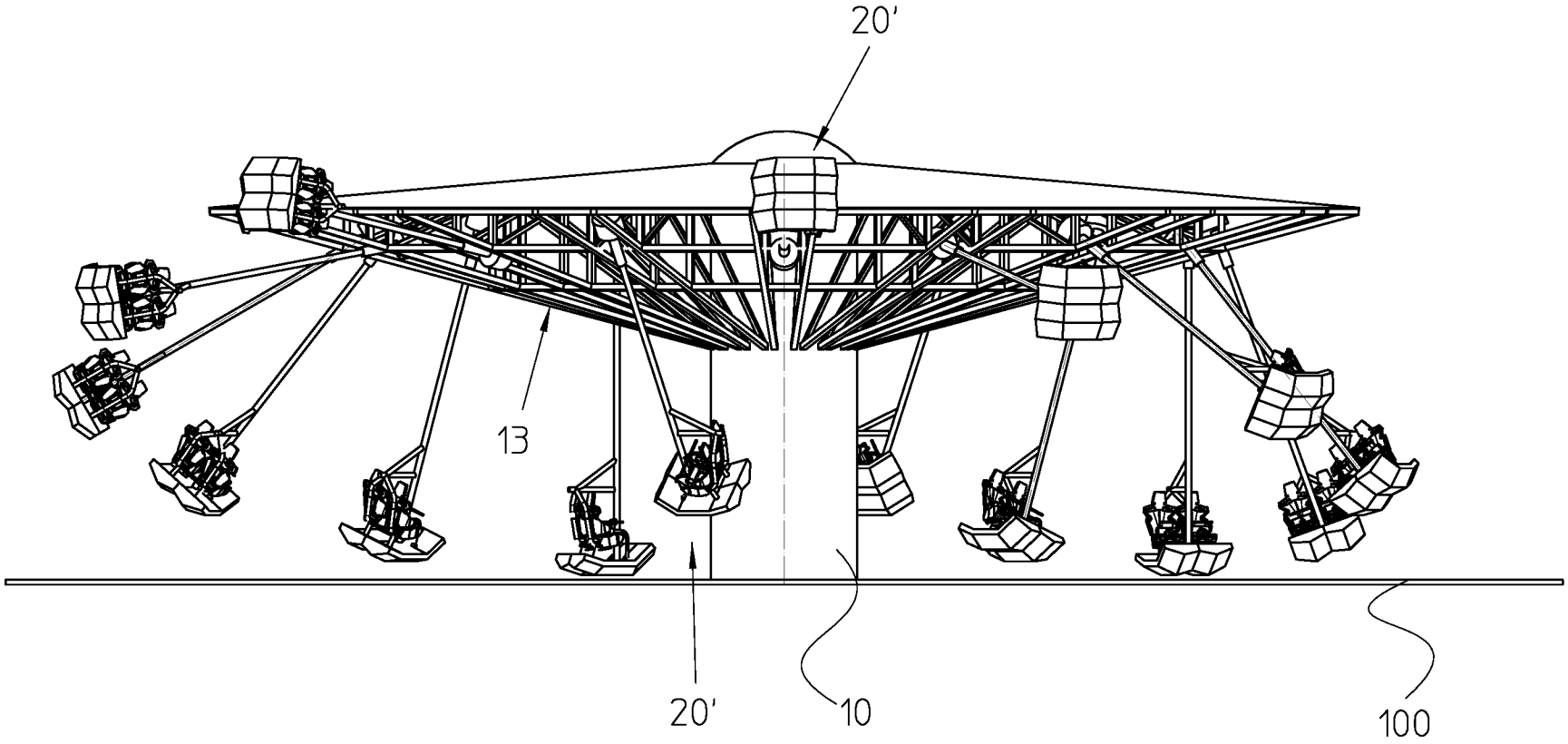
FIG. 5 shows a schematic view of a second preferred embodiment of the swing ride attraction according to the invention in the operating position.
Figure 6:
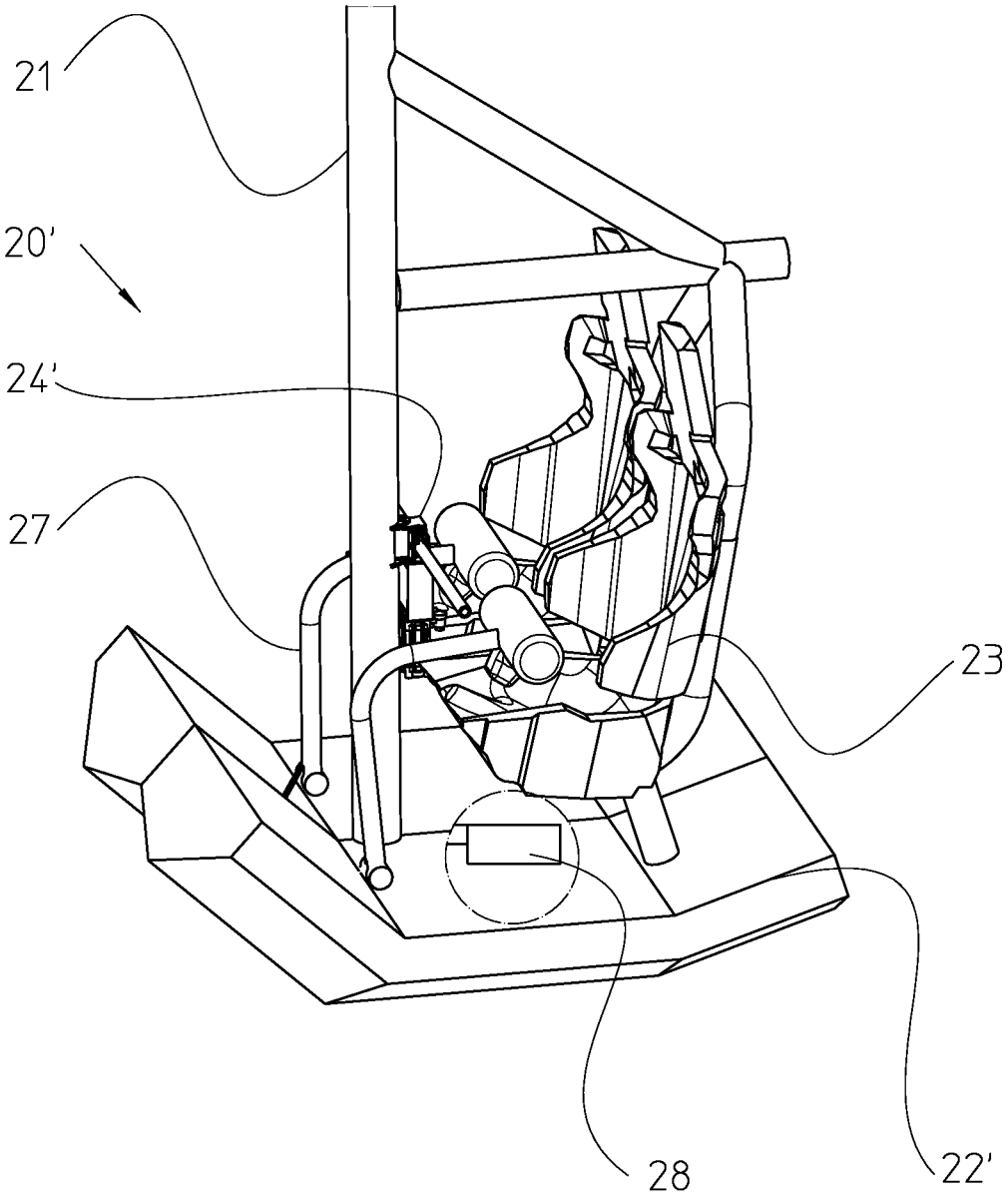
FIG. 6 shows part of the swing ride attraction of FIG. 5 in more detail.

FIG. 5 shows a schematic view of a second preferred embodiment of the swing ride attraction according to the invention in the operating position, and FIG. 6 shows part of the swing ride attraction of FIG. 5 in more detail.

The second preferred embodiment differs from the first preferred embodiment with respect to the subframe 20'. In the subframe 20', the gondola 22' is fixedly attached to the connecting arm 21. Each subframe 20' is additionally provided with an additional mass 28, which is movably mounted on the subframe 20'. The mass 28 is optionally movably mounted on the gondola 22', for example in the chassis of the gondola 22', and then preferably hidden from view. The movement of the mass 28 can be a rotational movement, for example about the connecting arm 21, or a translational movement, at least partly in the radial direction.

Optionally, the control means 24" are arranged for moving the mass 28 relative to the subframe 20'.

In the first and second preferred embodiments, the control means 24, 24' are mounted in or near the gondola 22, 22' and the control means are operable by the passenger. The control means 24, 24' are also referred to as passenger control means. The passenger control means are optionally actuated, for example pneumatically, hydraulically or electrically actuated.

Optionally, the control means comprise central control means, which are arranged for central control by an operator outside the attraction. The central control means (not shown) are arranged in the first preferred embodiment for rotating the gondola 22 about the connecting arm 21 and are arranged, in the second preferred embodiment, for moving the mass 28 in the gondola 22'. These central control means can be provided in addition to the passenger control means or as an alternative thereto.

Optionally, each subframe 20, 20' is provided with a counterweight 29, which is fixedly attached to the end of the connecting arm 21 of the subframe 20 opposite the gondola 22, 22' above the pivot point of the subframe. This pivot point is formed by a pivot axis 14 around which the subframe is freely pivotably suspended from the base frame by means of the connecting arm.

The attraction 1 is optionally provided with a platform 100 on which the mast 10 extends. In the boarding position, seats 23 are accessible to passengers from platform 100.

The present invention is of course not limited to the shown and described preferred embodiments. In a variant, the base frame 13 can for instance be mounted on a hub, which is also movably mounted on the mast in the longitudinal direction of the mast 10 and is provided with means for moving the hub in longitudinal direction of the mast 10.

The present invention therefore includes any embodiment which falls within the scope of the accompanying claims, seen in the light of the accompanying figures.

The invention claimed is:

1. Attraction for amusement rides, comprising a mast, a base frame rotatably attached to the mast and extending radially from the mast, means for rotating the base frame, a number of subframes, each comprising a stiff connecting arm to which a gondola with one or more passenger seats is attached, in which the subframes are circumferentially distributed, each suspended freely pivotable by means of the connecting arm on the base frame, such that the subframes with gondolas swing upon rotation of the base frame under influence of the centrifugal force, wherein the attraction further comprises control means for controlling the pivoting of the subframes with gondolas relative to the base frame, wherein the control means are arranged to displace the center of gravity of the subframe relative to the base frame, wherein the control means are arranged to move a mass in the subframe in a radial direction relative to the mast, which mass is located at the end of the connecting arm and is formed by the gondola itself or by an additional mass mounted in the chassis of the gondola.

2. Attraction according to claim 1, wherein each gondola is rotatably attached to the associated connecting arm, wherein the center of gravity of the gondola is positioned eccentrically with respect to the connecting arm and wherein the control means are arranged for rotation of the gondola with respect to the connecting arm.

3. Attraction according to claim 1, wherein the additional mass is hidden from view.

4. Attraction according to claim 1, in which each gondola is fixedly attached in the associated subframe.

5. Attraction according to claim 1, wherein the control means comprise passenger control means, which are arranged near the gondola and are arranged to be controlled by a passenger in the gondola.

6. Attraction according to claim 1, wherein the control means are actuated, for instance pneumatically, hydraulically or electrically actuated.

7. Attraction according to claim 1, in which the control means comprise central control means, which are arranged for central control by an operator outside the attraction.

8. Attraction according to claim 1, wherein each subframe is suspended pivotably about a pivot axis to the connecting arm on the base frame and wherein each subframe is provided with a counterweight, which is fixedly attached on the end of the subframe opposite the gondola above the pivot axis.

9. Attraction according to claim 1, wherein the attraction further comprises a hub movably mounted to the mast in the longitudinal and circumferential direction of the mast and means for moving the hub.

* * * * *